US005487191A

United States Patent [19]

Ridley

[11] Patent Number: 5,487,191

[45] Date of Patent: Jan. 30, 1996

[54] VENTED VISOR CAP

[76] Inventor: Robert L. Ridley, 3304 Country Club La., Altoona, Wis. 54720

[21] Appl. No.: 292,384

[22] Filed: Aug. 18, 1994

[51] Int. Cl.[6] ..... A42B 1/04

[52] U.S. Cl. ..... 2/195.1; 2/10; 2/12; 2/DIG. 1

[58] Field of Search ..... 2/7, 12, 171, 175.1, 2/195.1, DIG. 1, 10, 11, 15, 171.3, 175.5, 184.5, 195.6

[56] References Cited

U.S. PATENT DOCUMENTS 2,874,387 2/1959 Bannister et al. ..... 2/195.1
3,927,421 12/1975 Simon ..... 2/12

*Primary Examiner*—Diana Biefeld

[57] ABSTRACT

A cap or hat having a visor for permitting a flow of air through the visor, thereby precluding unintentional removal of the cap by wind currents. The inventive device includes a cap having a visor;extending outwardly therefrom, with the visor having a semi-circular aperture extending therethrough. A venting assembly extends across the visor aperture and is secured to forward and lateral edges of the visor aperture only, thereby allowing a trailing edge of the venting assembly to be fluidly biased out of the plane of the visor such that a pressure differential across the visor is reduced. The device may take the form of an integrally molded vent having a predetermined shape and fixedly secured to the visor. In addition, mounting plates facilitating the retrofitting of existing caps are also provided.

1 Claim, 5 Drawing Sheets

FIG 3
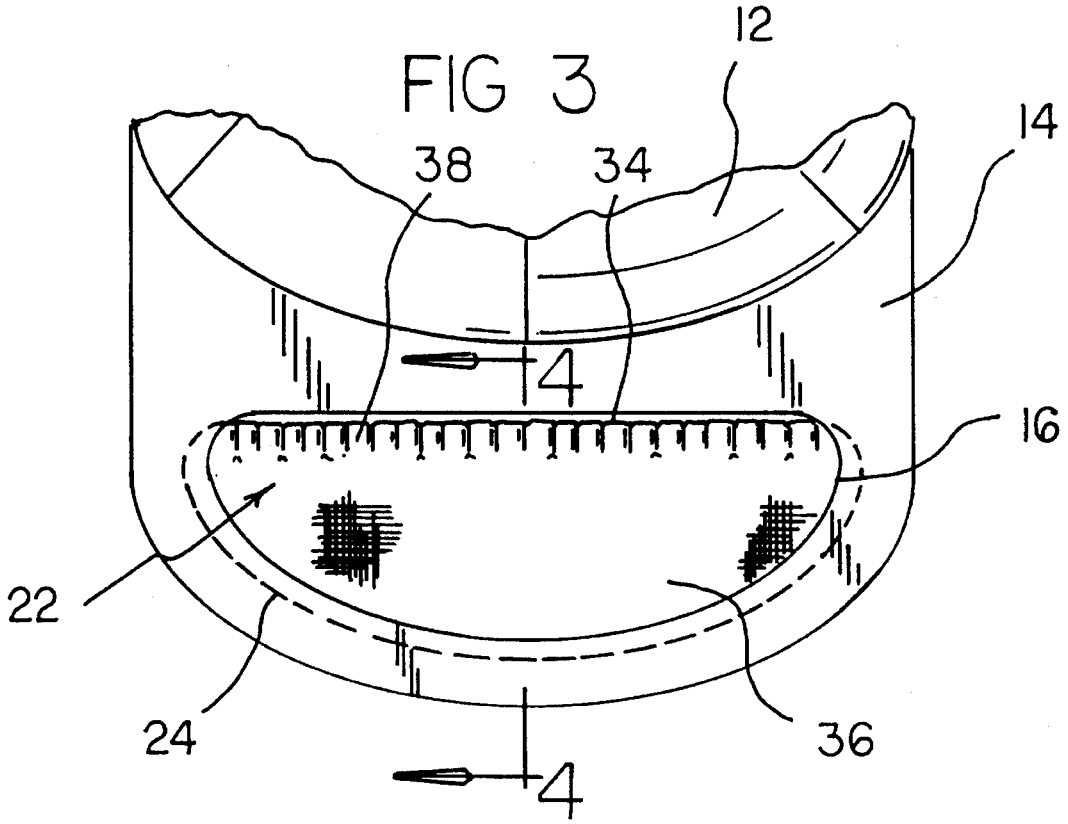
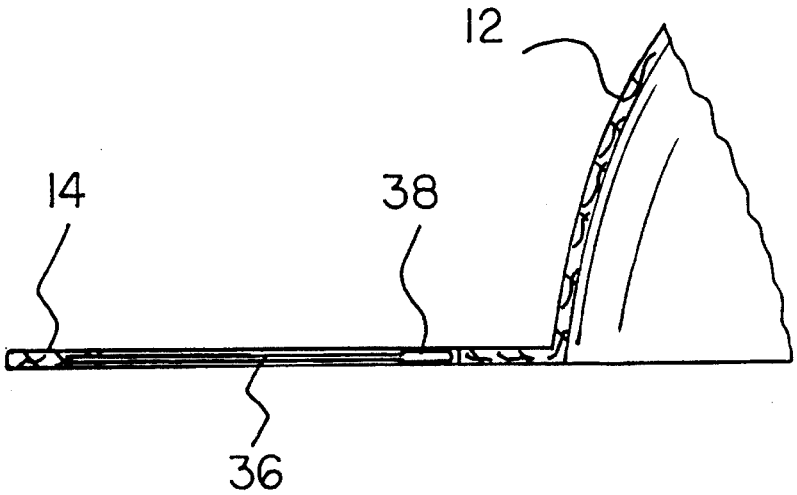
FIG 4

FIG 8
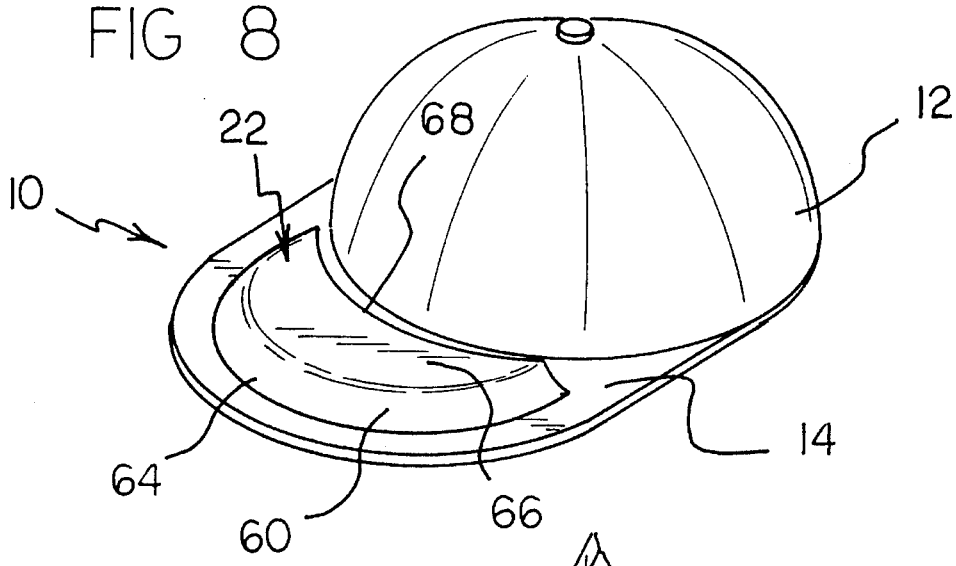
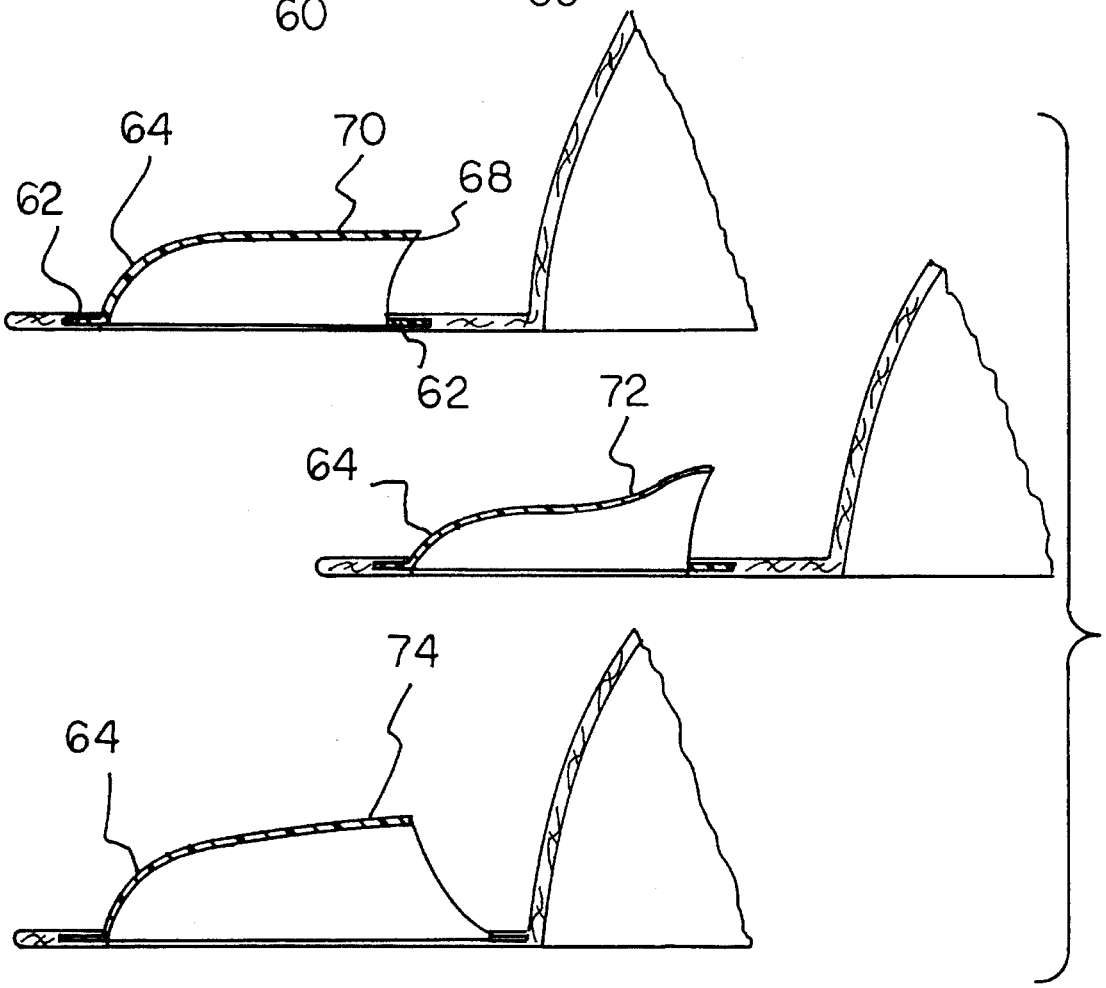
FIG 9

VENTED VISOR CAP

BACKGROUND OF THE INVENTION

1. Field of the Invention

The present invention relates to headwear and more particularly pertains to a vented visor cap permitting a flow of air through the visor, thereby precluding unintentional removal of the cap by wind currents.

2. Description of the Prior Art

The use of headwear is known in the prior art. More specifically, headwear heretofore devised and utilized for the purpose of reducing glare and shielding the eyes of the wearer are known to consist basically of familiar, expected and obvious structural configurations, notwithstanding the myriad of designs encompassed by the crowded prior art which have been developed for the fulfillment of countless objectives and requirements.

For example, a ventilated athletic cap is illustrated in U.S. Pat. No. 4,550,445 which comprises an adjustable headband, a semi-rigid visor attached to the headband and extending along the front and both sides of the cap, and a canopy attached to the outer edges of the visor. The canopy is made of formed cloth or semi-rigid material so as to maintain its shape and keep a spaced relation between the cap and the head of the wearer. The canopy further contains air vents in the front and rear so as to permit the unrestricted flow of air about the head of the wearer.

Another patent of interest is U.S. Pat. No. 4,546,496 which discloses a hat mounted ventilation apparatus in which an aperture is formed in the brim or front section of a hat or cap which is adapted to receive the body of the ventilating apparatus. A direct current motor is installed at the center of the mounted body, the shaft of the motor being directly coupled to a multiple bladed impeller. A directional visor is mounted below the impeller and in juxtaposition to the user's face for directing the flow of air resulting from a rotation of the impeller.

Other known prior art articles of headwear are disclosed in U.S. Pat. No. 4,249,269; and U.S. Pat. No. 5,157,788.

While these devices fulfill their respective, particular objectives and requirements, the aforementioned patents do not disclose a vented visor cap permitting a flow of air through the visor, thereby precluding unintentional removal of the cap by wind currents which includes a cap having a visor extending outwardly therefrom, with the visor having a semi-circular aperture extending therethrough, and a venting assembly extending across the visor aperture and secured to forward and lateral edges of the visor, thereby allowing a trailing edge of the venting assembly to be fluidly biased out of the plane of the visor such that a pressure differential across the visor is reduced. Furthermore, none of the known prior art articles of headwear teach or suggest a vented visor cap of the aforementioned structure which further includes mounting plates facilitating the retro-fitting of existing caps.

In these respects, the vented visor cap according to the present invention substantially departs from the conventional concepts and designs of the prior art, and in so doing provides an apparatus primarily developed for the purpose of permitting a flow of air through the visor, thereby precluding unintentional removal of the cap by wind currents.

SUMMARY OF THE INVENTION

In view of the foregoing disadvantages inherent in the known types of headwear now present in the prior art, the present invention provides a new vented visor cap construction wherein the same can be utilized permitting a flow of air through the visor, thereby precluding unintentional removal of the cap by wind currents. As such, the general purpose of the present invention, which will be described subsequently in greater detail, is to provide a new vented visor cap apparatus and method which has many of the advantages of the headwear mentioned heretofore and many novel features that result in a vented visor cap which is not anticipated, rendered obvious, suggested, or even implied by any of the prior art headwear, either alone or in any combination thereof.

To attain this, the present invention generally comprises a cap or hat having a visor for permitting a flow of air through the visor, thereby precluding unintentional removal of the cap by wind currents. The inventive device includes a cap having a visor extending outwardly therefrom, with the visor having a semi-circular aperture extending therethrough. A venting assembly extends across the visor aperture and is secured to forward and lateral edges of the visor aperture only, thereby allowing a trailing edge of the venting assembly to be fluidly biased out of the plane of the visor such that a pressure differential across the visor is reduced. The device may take the form of an integrally molded vent having a predetermined shape and fixedly secured to the visor. In addition, mounting plates facilitating the retro-fitting of existing caps are also provided.

There has thus been outlined, rather broadly, the more important features of the invention in order that the detailed description thereof that follows may be better understood, and in order that the present contribution to the art may be better appreciated. There are, of course, additional features of the invention that will be described hereinafter and which Will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vented visor cap apparatus and method which has many of the advantages of the headwear mentioned heretofore and many novel features that result in a vented visor cap which is not anticipated, rendered obvious, suggested, or even implied by any of the prior art headwear, either alone or in any combination thereof.

It is another object of the present invention to provide a new vented visor cap which may be easily and efficiently manufactured and marketed.

It is a further object of the present invention to provide a new vented visor cap which is of a durable and reliable construction.

An even further object of the present invention is to provide a new vented visor cap which is susceptible of a low cost of manufacture with regard to both materials and labor, and which accordingly is then susceptible of low prices of sale to the consuming public, thereby making such vented visor caps economically available to the buying public.

Still yet another object of the present invention is to provide a new vented visor cap which provides in the apparatuses and methods of the prior art some of the advantages thereof, while simultaneously overcoming some of the disadvantages normally associated therewith.

Still another object of the present invention is to provide a new vented visor cap for permitting a flow of air through the visor, thereby precluding unintentional removal of the cap by wind currents.

Yet another object of the present invention is to provide a new vented visor cap which includes a cap having a visor extending outwardly therefrom, with the visor having a semi-circular aperture extending therethrough, and a venting assembly extending across the visor aperture and secured to forward and lateral edges of the visor, thereby allowing a trailing edge of the venting assembly to be fluidly biased out of the plane of the visor such that a pressure differential across the visor is reduced.

Even still another object of the present invention is to provide a new vented visor cap which comprises an integrally molded vent having a predetermined shape, with the molded vent being either fixedly secured to the visor or integrally molded with the visor.

Even still yet another object of the present invention is to provide a new vented visor cap including mounting plates facilitating the retro-fitting of existing caps.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top plan view of a vented visor cap having a single vent web.

FIG. 4 is a cross sectional view taken along line 4—4 of FIG. 3.

FIG. 8 is an isometric illustration of the vented visor cap including a molded vent.

FIG. 9 is a cross sectional view illustrating various molded vent profiles.

DESCRIPTION OF THE PREFERRED EMBODIMENT

Figure 1:
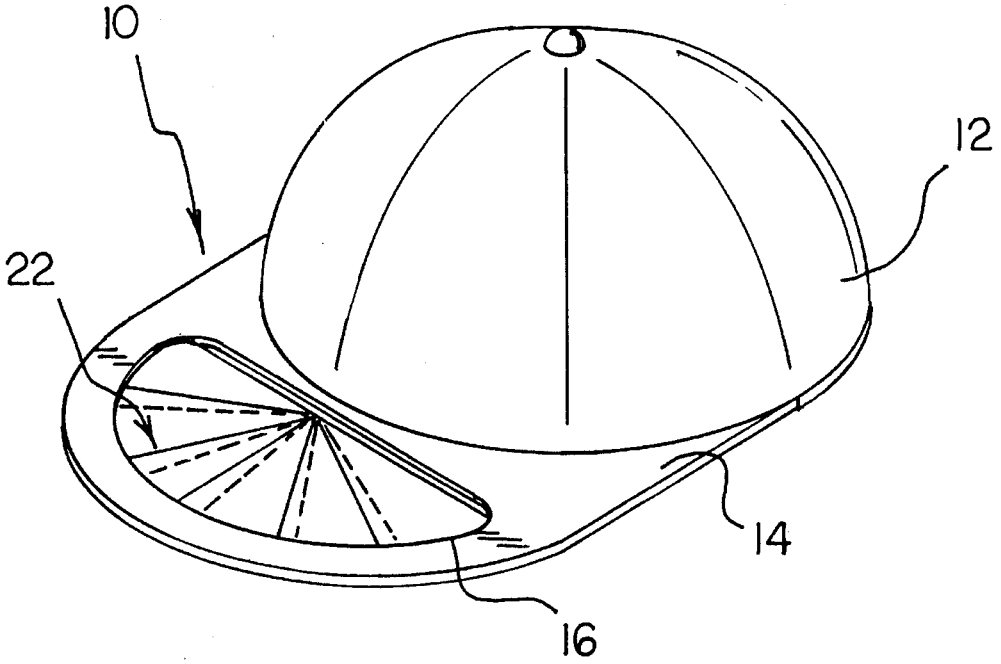
FIG. 1 is an isometric illustration of a vented visor cap according to the present invention.

With reference now to the drawings, and in particular to FIGS. 1–7 thereof, a new vented visor cap embodying the principles and concepts of the present invention and generally designated by the reference numeral 10 will be described.

More specifically, the vented visor cap 10 comprises an article of headwear such as a hat or a cap 12 which may be positioned about or upon the head of an individual. A visor 14 extends from the cap 12 and is operable to preclude the direct impinging of light upon the individual's eyes. The visor 14 is shaped so as to define a visor aperture 16 extending therethrough. Preferably, the visor aperture 16 is substantially semi-circular in shape, as illustrated in the plan view of FIG. 2, and includes contoured front and side edges 18 which extend therearound to meet with a preferably straight, but possibly contoured, rear edge 20. The visor aperture 16 allows a passage of air through the visor 14 which precludes unintentional removal of the visor cap 10 by oncoming wind currents, such as encountered during running, or traveling in open vehicles of any kind. Although not specifically illustrated, the cap 12 of the present invention is not intended to be limited to a baseball type hat, but may be configured as a batting helmet, a fishing-style cap, a cowboy hat, or any other conceivable hat configuration.

Figure 2:
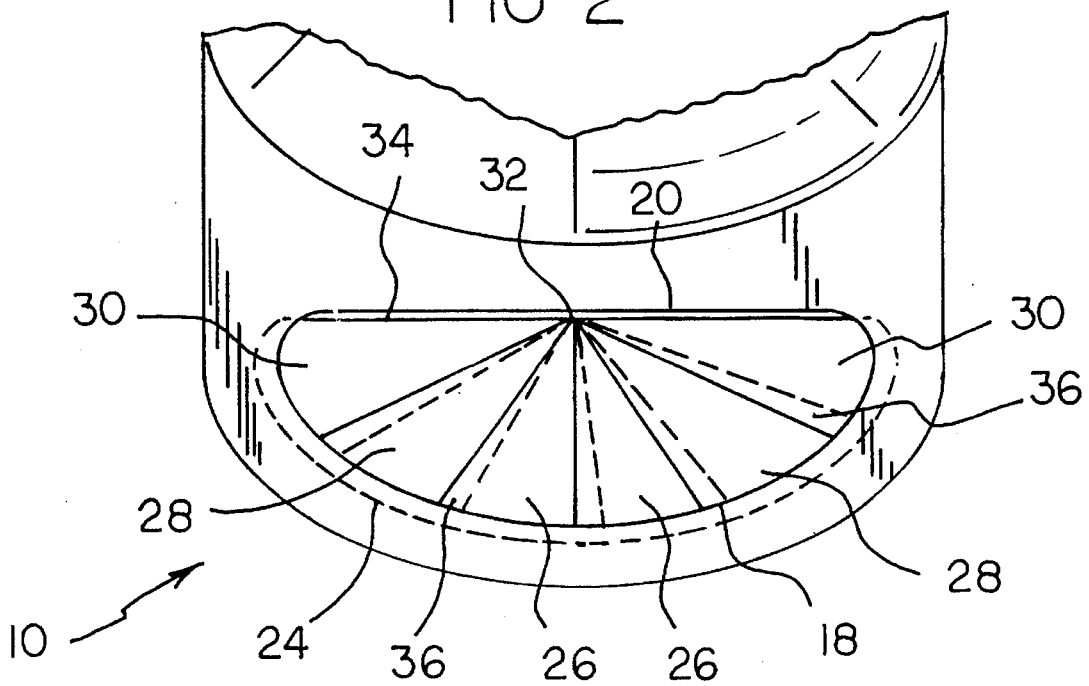
FIG. 2 is a top plan view of the cap.
Figure 5:
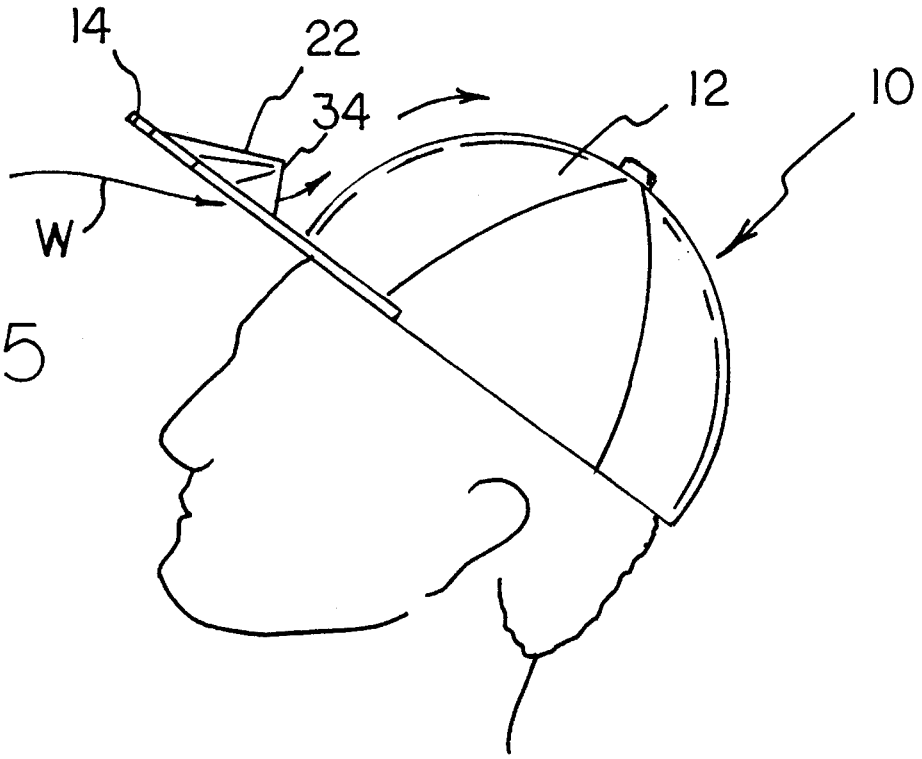
FIG. 5 is a side elevation view of the vented visor cap in a first use.
Figure 6:
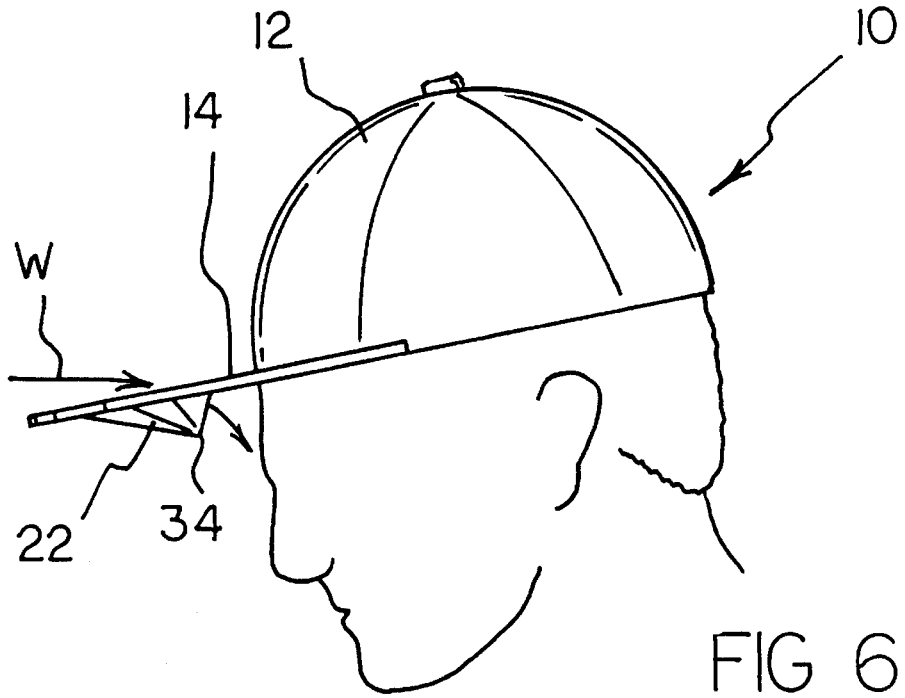
FIG. 6 is a further side elevation view of the vented visor cap in a second use.

To preclude a passage of light through the visor 14 while simultaneously permitting a passage of wind currents through the visor aperture 16, a venting assembly means 22 extends across the visor aperture, as illustrated in FIGS. 1 and 2 of the drawings. The venting assembly 22 is secured to the contoured front and side edges 18 of the visor aperture 16 by stitching 24, but is not connected to the rear edge 20. The venting assembly 22 comprises a plurality of vent webs which include inner vent webs 26, medial vent webs 28, and outer vent webs 30. The vent webs 26–30 are substantially triangular in shape and are joined together at a center 32 of the trailing edge 34 of the venting assembly 22. The vent webs 26–30 are arranged so as to slightly overlap one another as at 36 and may be stitched together along this overlap. Preferably, the vent webs 26–30 are not stitched together along the overlap 36 such that a passage of wind currents or the like through or across the overlap 36 is permitted. The vent webs 26–30 are preferably constructed of a substantially opaque or slightly translucent material of flexible nature. By this structure, the trailing edge 34 of the venting assembly 22 can be fluidly biased out of the plane of the visor 14 such that a pressure differential across the visor created by the oncoming wind "W" is substantially reduced. Thus, the vented visor cap 10 exhibits increased resistance to unintentional removal by such oncoming wind currents "W". In addition, it can be seen from FIGS. 5 and 6 that the venting assembly 22 may be biased either upward, as indicated in FIG. 5, or downward, as indicated in FIG. 6, as desired.

Referring now to FIGS. 3 and 4, it can be shown that the venting assembly means 22 may alternatively comprise a single vent web 36 of substantially resiliently deformable fabric material, rubber, or the like. The single vent web 36 extends across the visor aperture 16 and is secured to the visor 14 about the front and side edges 18 of the visor aperture by the stitching 24. The trailing edge 34 of the venting assembly 22 comprises an elasticized edge 38 which permits deformation of the single vent web 36 out of the plane of the visor 14 upon contact with the wind currents "W", and retains the single vent web within the plane of the visor absent such contact.

Figure 7:
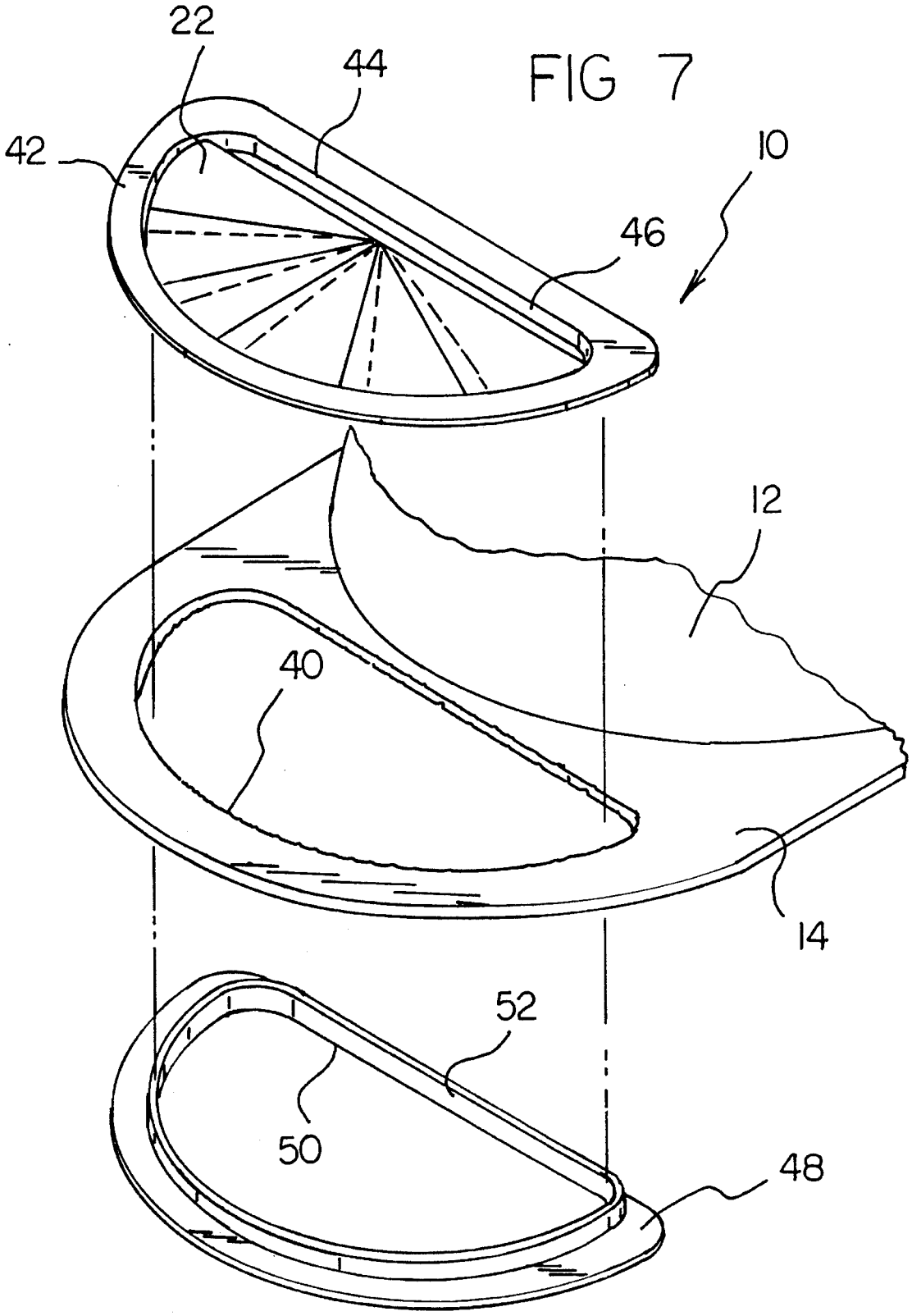
FIG. 7 is an exploded view of a vented visor cap including mounting plates which permit the retro-fitting of an existing cap.

FIG. 7 illustrates the inclusion of a pair of mounting plates which permit the retro-fitting of an existing cap 12 having a visor 14 extending therefrom. Such cap 12 may be modified by creating a roughly cut hole 40 through the visor 14. In this arrangement, the venting assembly 22 is secured to an upper mounting plate 42 across an upper mounting plate aperture 44. To this end, the venting assembly 22 and the upper mounting plate 42 may be integrally molded or joined together by adhesive or other fastening means. The upper mounting plate 42 includes a depending flange 46 which circumscribes the upper mounting plate aperture 44 and extends at least partially through the roughly cut hole 40. A lower mounting plate 48 having a lower mounting plate aperture 50 and an upstanding flange 52 which circumscribes the lower mounting plate aperture, may be selectively coupled to the upper mounting plate 42 to capture a portion of the visor 14 therebetween, thereby securing the venting assembly 22 across the roughly cut hole 40. To this end, the upper and lower mounting plates 42, 48 cooperate to effectively disguise the jagged edges of the roughly cut hole 40. The mounting plates 42, 48 may be joined together, and to the visor 14 if so desired, by adhesive, mechanical fasteners which extend therethrough, or other fastening means. Thus, the mounting plates 42, 48 permit the venting assembly 22 to be selectively mounted to an existing cap 12 subsequent to the creation of the hole 40 to the visor 14.

Referring now to FIGS. 8 and 9, it can be shown that the venting assembly means 22 of the present invention 10 may take the form of an integrally molded vent 60. In this configuration, the molded vent 60 comprises a flange 62 circumscribing the visor aperture 16 which can be stitched, glued, or otherwise secured to the visor 14 of the cap 12. Alternatively, the entire vent 60 including the flange 62 can be integrally molded into the visor 14. In other words, the visor 14 and the vent 60 can be molded as a single unit to reduce production costs of the device 10. Continuing, the molded vent 60 includes an arcuate leading wall 64 which extends upwardly and rearwardly from the forwardmost portion of the flange 62 and continues into an upper wall 66 spaced above the flange 62. The upper wall 66 terminates in an arcuate trailing edge 68 spaced from a rearwardmost portion of the flange 62. By this structure, wind currents are permitted to pass through the visor aperture 16, while a passage of light through the aperture is simultaneously precluded.

FIG. 9 illustrates in cross section the various profiles that the vent 60 can be molded into. In this respect, the molded vent 60 may include a flat upper wall 70 extending from the arcuate leading wall 64 and parallel to the visor 14, a contoured up per wall 72 extending rearwardly from the arcuate leading wall, or an angled upper wall 74 extending from the arcuate leading wall at an oblique angle relative to the visor. In addition, it is contemplated that the molded vent 60 could also be integrally formed with the pair of mounting plates described above to permit the retro-fitting of an existing cap 12 having a visor 14 extending therefrom. In this configuration, the molded vent 60 of the venting assembly 22 is secured to the upper mounting plate 42 across the upper mounting plate aperture 44, whereby the upper plate can be joined to the lower mounting plate 48 to couple the vent 60 to the visor 14 in a now apparent manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A vented visor cap comprising:

an article of headwear;

a visor attached to said article of headwear and extending therefrom, said visor having a visor aperture extending therethrough; and, venting means for reducing a passage of light through said visor aperture and permitting a passage of wind currents through said visor aperture, wherein said venting means comprises a plurality of inner vent webs, a plurality of medial vent webs, and a plurality of outer vent webs, each of said webs being joined to a portion of said visor proximal to said visor aperture and joined together at a center point of a trailing edge of said venting means.

* * * * *